US008074734B2

(12) United States Patent
Gumpert et al.

(10) Patent No.: US 8,074,734 B2
(45) Date of Patent: Dec. 13, 2011

(54) POWERED HAMMER WITH A VIBRATION DAMPENING MECHANISM

(75) Inventors: Rene Gumpert, Schoeneck (DE); Heinz-Werner Faatz, Schmitten (DE)

(73) Assignee: Black & Decker Inc., Newark, DE (US)

( * ) Notice: Subject to any disclaimer, the term of this patent is extended or adjusted under 35 U.S.C. 154(b) by 89 days.

(21) Appl. No.: 12/404,381

(22) Filed: Mar. 16, 2009

(65) Prior Publication Data

US 2009/0236113 A1 Sep. 24, 2009

(30) Foreign Application Priority Data

Mar. 18, 2008 (GB) ..... 0804967.8

(51) Int. Cl.
*B25D 17/24* (2006.01)

(52) U.S. Cl. ..... 173/210; 173/162.1; 173/162.2

(58) Field of Classification Search ..... 173/210, 173/162.1, 162.2
See application file for complete search history.

(56) References Cited

U.S. PATENT DOCUMENTS 4,316,512 A * 2/1982 Kibblewhite et al. ..... 173/183
4,599,007 A * 7/1986 Khorsand ..... 400/322
4,677,892 A * 7/1987 Kramer et al. ..... 84/405
4,711,308 A 12/1987 Blaas et al.
4,747,455 A * 5/1988 Cunningham ..... 173/1
7,506,694 B2 * 3/2009 Stirm et al. ..... 173/178
7,712,547 B2 * 5/2010 Ikuta et al. ..... 173/162.1
2006/0124331 A1 * 6/2006 Stirm et al. ..... 173/178
2008/0189870 A1 * 8/2008 Dayton et al. ..... 7/167
2009/0032275 A1 * 2/2009 Ikuta et al. ..... 173/117

FOREIGN PATENT DOCUMENTS

CN 101077577 11/2007
JP 2640124 12/1989
JP 2007175837 7/2007

* cited by examiner

*Primary Examiner* — Brian D Nash
(74) *Attorney, Agent, or Firm* — Kofi Schulterbrandt; Scott B. Markow; Adan Ayala

(57) ABSTRACT

A powered hammer is described comprising a housing, a tool holder mounted on the housing, a percussion mechanism arranged within the housing which mechanism includes a ram reciprocating in a longitudinal direction and being adapted to apply impacts on a tool bit supported in the tool holder, a dampening mass which is slidably mounted in the longitudinal direction within the housing, wherein the dampening mass is biased towards a neutral position by a biasing element and wherein the dampening mass may be deflected from the neutral position against the biasing force of the biasing element. The dampening mass is formed of a ferromagnetic or paramagnetic material or comprises a permanent magnet and a solenoid is arranged within housing adjacent to the dampening mass such that the solenoid applies a force in the longitudinal direction on the dampening mass when being in the neutral position if a current is flowing through the solenoid.

16 Claims, 6 Drawing Sheets

POWERED HAMMER WITH A VIBRATION DAMPENING MECHANISM

CROSS-REFERENCE TO RELATED APPLICATIONS

This application claims priority, under 35 U.S.C. §119(a)-(d), to UK Patent Application No. GB 08 049 67.8 filed Mar. 18, 2008, the contents of which is incorporated herein by reference in its entirety.

FIELD OF THE INVENTION

The present invention relates to a powered hammer comprising a housing, a tool holder mounted on the housing, a percussion mechanism arranged within the housing which mechanism includes a ram reciprocating in a longitudinal direction and being adapted to apply impacts on a tool bit supported by the tool holder, a dampening mass which is mounted slidably in the longitudinal direction within the housing, wherein the dampening mass is biased towards a neutral position by a biasing element and wherein the dampening mass may be deflected from the neutral position against the biasing force of the biasing element.

BACKGROUND OF THE INVENTION

Such powered hammers can be employed to conduct demolition works wherein a tool bit formed as a chisel is usually driven into the material of the work piece. In addition, it can be conceived that the hammer is constructed as a hammer drill with a tool holder which is also rotationally driven. In this case a drill bit may be used as tool bit rather than a chisel.

In both cases considerable vibrations occur during use which are due to the percussion mechanism. These vibrations are transferred to the user via a handle mounted on the hammer housing and due to the high performance of chisel or demolition hammers the problem arises that the vibrations can reach a considerable strength and may cause damage to the user's health. Thus it is required to provide for an effective dampening mechanism.

From the prior art it is known to employ passive dampening systems in a powered hammer. For this purpose the handle can be decoupled from the main housing so as to reduce the amplitude of the vibrations transferred to the handle.

Furthermore, EP 1 252 976 A1 discloses a hammer with a dampening mass within the hammer housing which mass is movable in the moving direction of the ram and, thus, in the longitudinal direction wherein the mass is supported by two springs. The system comprising the mass and the springs is dimensioned in such a manner that the resonance frequency of the system corresponds to the frequency with which the ram impinges on the tool bit and the beat piece, respectively. During use the mass is stimulated to oscillate opposite to the reciprocating movement of the ram, and hence the overall vibrations of the hammer are reduced.

In addition, there are active dampening systems known from the prior art which systems employ a counter mass which is directly driven by the percussion mechanism wherein the counter mass is moving in an opposite direction relative to the ram.

However, the prior art dampening systems do not allow to control the amplitude and the time dependence of the movement of the dampening mass. In particular it is not possible to control the effect of the dampening system depending on the vibrations which are present on the housing of the hammer.

Moreover, the regulations regarding the maximum amplitude of vibrations occurring on hammers have recently been considerably tightened which results in a further need for a better vibration reduction on these tools.

Therefore, it is the object of the present invention to provide a powered hammer wherein the vibrations generated by a the hammer and transferred to a user are effectively reduced.

BRIEF SUMMARY OF THE INVENTION

According to the invention this object is achieved in that the dampening mass is formed of a ferromagnetic or paramagnetic material or comprises a permanent magnet and that a solenoid is arranged within housing adjacent to the dampening mass such that the solenoid applies a force in the longitudinal direction on the dampening mass when being in the neutral position if a current is flowing through the solenoid.

By means of the solenoid the dampening mass can be accelerated in a controlled manner due to the magnetic field generated by a current flowing through the solenoid. Thus, the arrangement of a solenoid and a magnetic dampening mass enables to selectively stimulate the dampening system.

In a preferred embodiment the hammer comprises a control unit which applies a current to the solenoid depending on a signal which is a measure for the acceleration of the housing in the longitudinal direction. This allows accelerating the dampening mass in response to the vibrations being present on the housing for reducing these vibrations. In particular, it is possible to mount an acceleration sensor on the tool housing.

However, it can be conceived that the solenoid is also effective as an acceleration sensor. In this case a low current is directed to the solenoid and variations of the resistance of the solenoid are detected which variations occur when the dampening mass enters the region of the solenoid. The time dependence of the variations allows determining the characteristics of the vibrations of the tool housing.

As an alternative, a second solenoid may be provided which is arranged such that the dampening mass when moving in the longitudinal direction approaches or departs from the second solenoid. In this case, the movement of the dampening mass and hence the vibrations of the hammer are determined based on the variation of the resistance of the second solenoid.

In any case, the signal generated by the acceleration sensor, the solenoid for accelerating the dampening mass or the second solenoid is used by the control unit to selectively direct a current through the solenoid in order to accelerate the dampening mass in an appropriate manner.

In a preferred embodiment, the percussion mechanism comprises a cylinder element in which the ram is movably located. The dampening mass has a circular shape and is arranged around the cylinder element wherein the dampening mass is supported by a spring extending in the longitudinal direction. Such an arrangement comprising the percussion and dampening mechanism has proven to be relatively space saving.

Here, it is preferred if the dampening mass is surrounded by a percussion mechanism housing wherein the solenoid is located along the circumference of the percussion mechanism housing spaced in the longitudinal direction from the neutral position of the dampening mass.

In case of a configuration with a percussion mechanism housing the solenoid may either be mounted on the outside of the housing with the solenoid being easily accessible or a ring shaped recess may be provided which is located in the surface of the percussion mechanism housing facing the dampening mass. In the latter case, the solenoid may be arranged close to the dampening mass which would require only small currents to accelerate the dampening mass. This would facilitate to employ the solenoid also as a sensor.

BRIEF DESCRIPTION OF THE DRAWINGS

Embodiments of a powered hammer according to the present invention will now be described by way of example with reference to the accompanied drawings in which.

DETAILED DESCRIPTION OF THE INVENTION

Figure 1:
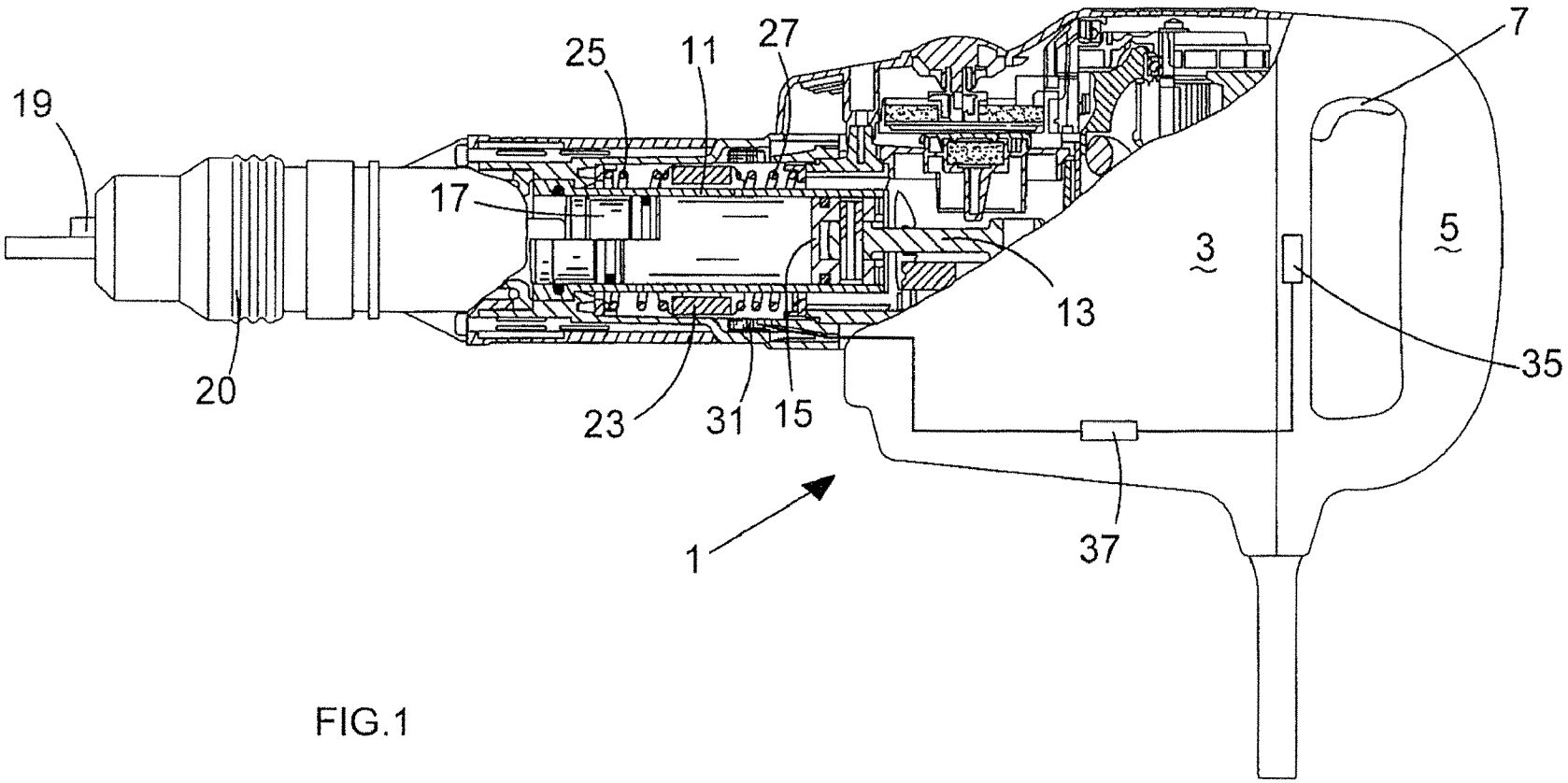
FIG. 1 shows a longitudinal cross section through a powered demolition hammer according to a first embodiment of the present invention.
Figure 2:
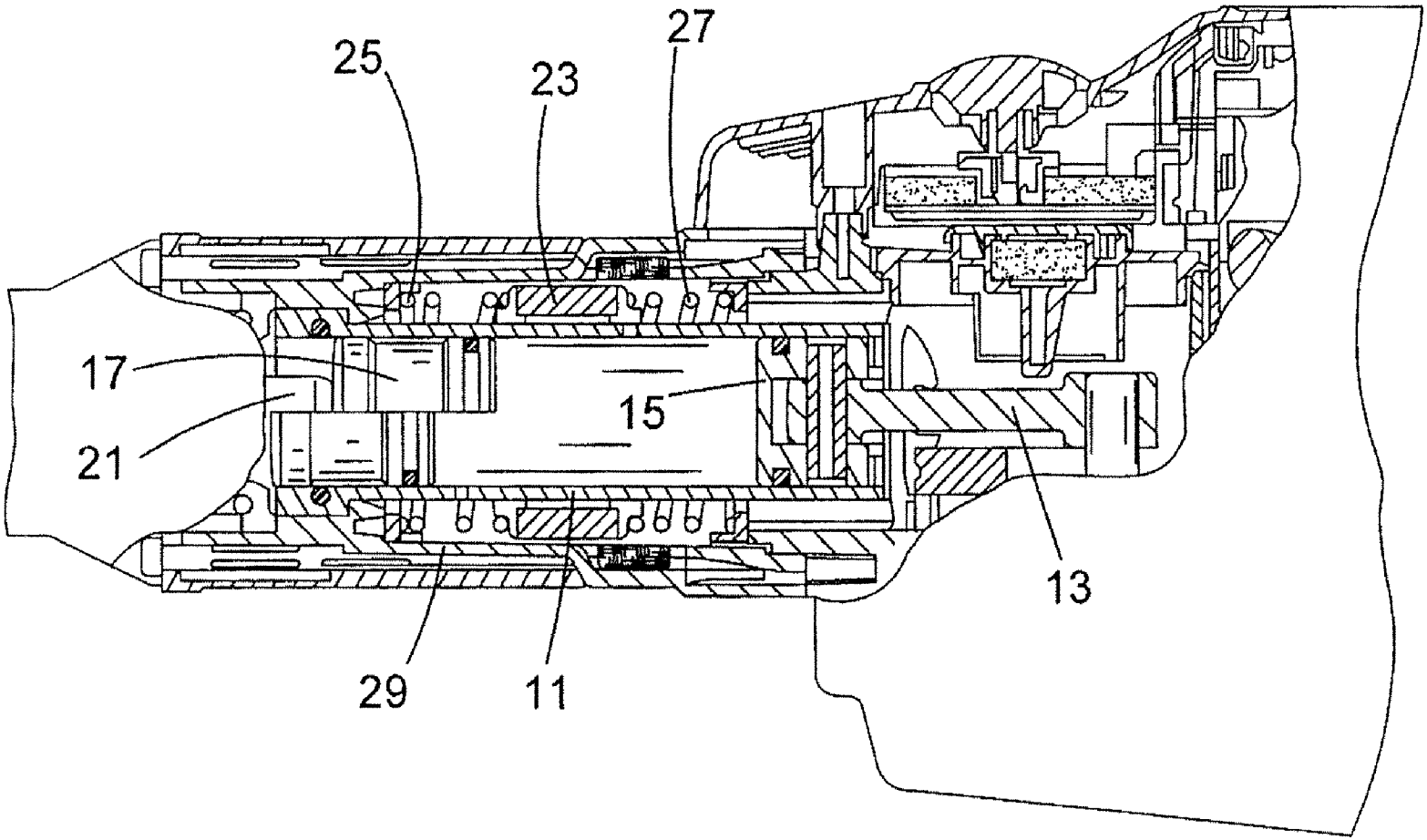
FIG. 2 shows an enlarged longitudinal cross-section of the spindle portion of the powered hammer shown in FIG. 1.
Figure 3:
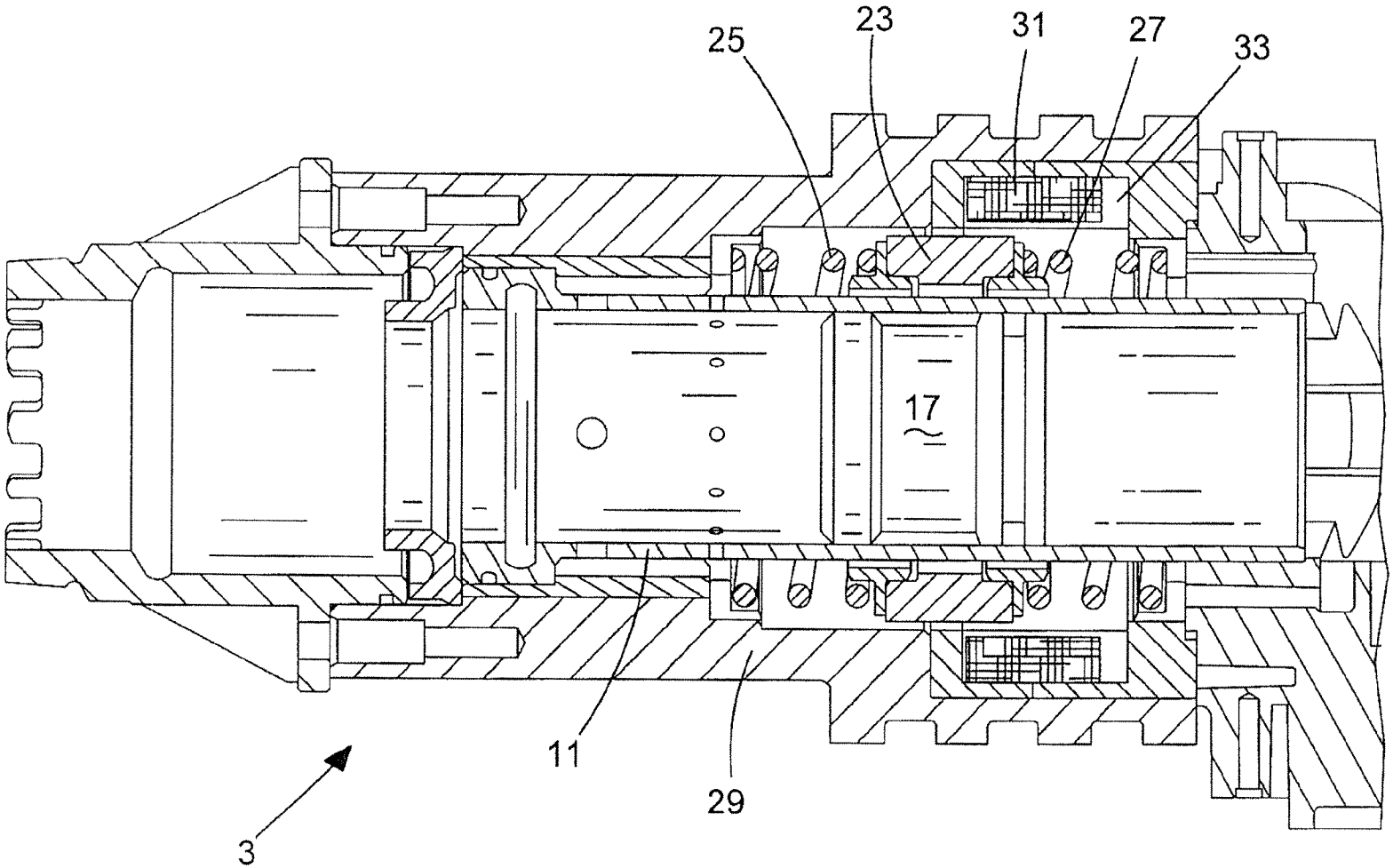
FIG. 3 shows an enlarged longitudinal cross-section of the percussion mechanism of the powered hammer shown in FIG. 1.

A powered hammer according to a first embodiment of the present invention is shown in FIGS. 1 through 3. The hammer 1 comprises a housing 3 in which an electric motor (not shown in detail) is mounted. A handle 5 is provided at the rear end of the housing 3 which handle can be grasped by a user. In addition, the handle 5 comprises a trigger 7 to switch on the electric motor.

The electric motor is coupled with a percussion mechanism 9 which includes a cylinder element 11 in which a piston 15 is movably supported and reciprocatingly driven by a piston rod 13 coupled to a crank shaft. Furthermore, a ram 17 is arranged within the cylinder element 11 which is movable in a longitudinal direction that extends from the rear end of the cylinder element 11 to a tool bit 19. Thus, the longitudinal direction coincides with the moving direction of the piston 15 and the ram 17.

The ram 17 is adapted to apply impacts on the tool bit 19 supported in a tool holder 20. However, the ram 17 does not directly hit the tool bit 19 but a beat piece 21 which is arranged between the ram 17 and the tool bit 19. Depending on whether the tool holder 20 is also rotatingly driven, the tool bit 19 may be formed as a drill or a chisel bit.

The percussion mechanism is effective in a well known manner. Due to the air spring between the ram 17 and the piston 15 the ram 17 is reciprocating as a result of the reciprocating movement of the piston 15. The ram 17 is hitting the beat piece 21 so that the kinetic energy as well as the momentum is transferred to the tool bit 19. Thus, the percussion mechanism 9 applies impacts to the tool bit 19.

The reciprocating movement of the ram 17 and the impacts of the ram 17 on the beat piece 21 and the tool bit 19, respectively, result in vibrations which are sensed by a user. In order to reduce these vibrations a dampening mass 23 is provided which is mounted on the cylinder element 11 and is moveable in the longitudinal direction. The dampening mass 23 is supported between a front spring 25 and a rear spring 27 such that the dampening mass 23 is slideable in the longitudinal direction against the biasing force of the springs 25, 27.

The springs 25, 27 have the effect that the dampening mass 23 is biased towards a neutral position shown in the drawings and defined by the dimensions of the springs from which position the dampening mass may be deflected.

The dampening mass 23 is formed from a material on which a magnetic field applies a force. Hence, it is possible that it is a paramagnetic material, a ferromagnetic material or it is a permanent magnet.

The percussion mechanism 9 is surrounded by a percussion mechanism housing 29 with a solenoid 31 mounted thereon wherein a ring shaped recess 33 is provided being located in the surface of the percussion mechanism housing 29 facing the dampening mass 23. The solenoid 31 is positioned within the recess 33 along the circumference of the percussion mechanism housing 29. In addition, the solenoid 31 and the recess 33 are arranged such that the solenoid 31 is spaced in the longitudinal direction from dampening mass 23 when being in the neutral position. This has the effect that a current flowing through the solenoid 31 results in force on the dampening mass 23 if it is in the neutral position.

Finally, an acceleration sensor 35 is mounted on the housing 3 which is connected with a control unit 37. The unit 37 is in turn coupled to the solenoid 31. As acceleration sensor 37 is possible to employ a piezo-resistive, a piezo-electrical or a capacitive sensor. These sensors are capable to convert an acceleration of the housing 3 into an electrical signal which is then sent to the control unit 37. In response to the signal supplied by the sensor 35 the control unit 37 applies a current to the solenoid 31 to accelerate the dampening mass 23 in an appropriate manner by the resulting magnetic field. Accordingly, the solenoid 31 is supplied with a current in relation to a signal which is a measure for the acceleration of the housing 3 in the longitudinal direction.

With the assembly according to the present invention the movement of the dampening mass 23 may be controlled as follows. The time dependence of the acceleration of the housing 3 in the longitudinal direction will be detected by the acceleration sensor 35 and based on that measurand the solenoid 31 is supplied with a current to deflect the dampening mass 23 from the neutral position such that it moves in an opposite direction compared to the vibrations of the housing to reduce the amplitude of the vibrations or to cancel them out.

Whilst in this embodiment the vibrations are detected by an additional sensor 35 it may be conceived that in a first step the movement of the housing 3 as a result of the vibrations is detected by measuring the resistance of the solenoid 31 as a function of time. The resistance varies depending on the position of the dampening mass 23 with respect to the solenoid 31, and thus allows determining the time dependence of the movement of the dampening mass 23 and the characteristics of the vibrations. The resistance may be measured by applying a small current to the solenoid 31 and calculating the corresponding resistance values based on the voltage drop. Based on the position of the dampening mass 23 determined via the resistance measurement, current pulses are applied to the solenoid 31 in order deflect the mass 23 in a controlled manner to reduce the vibrations.

Figure 4:
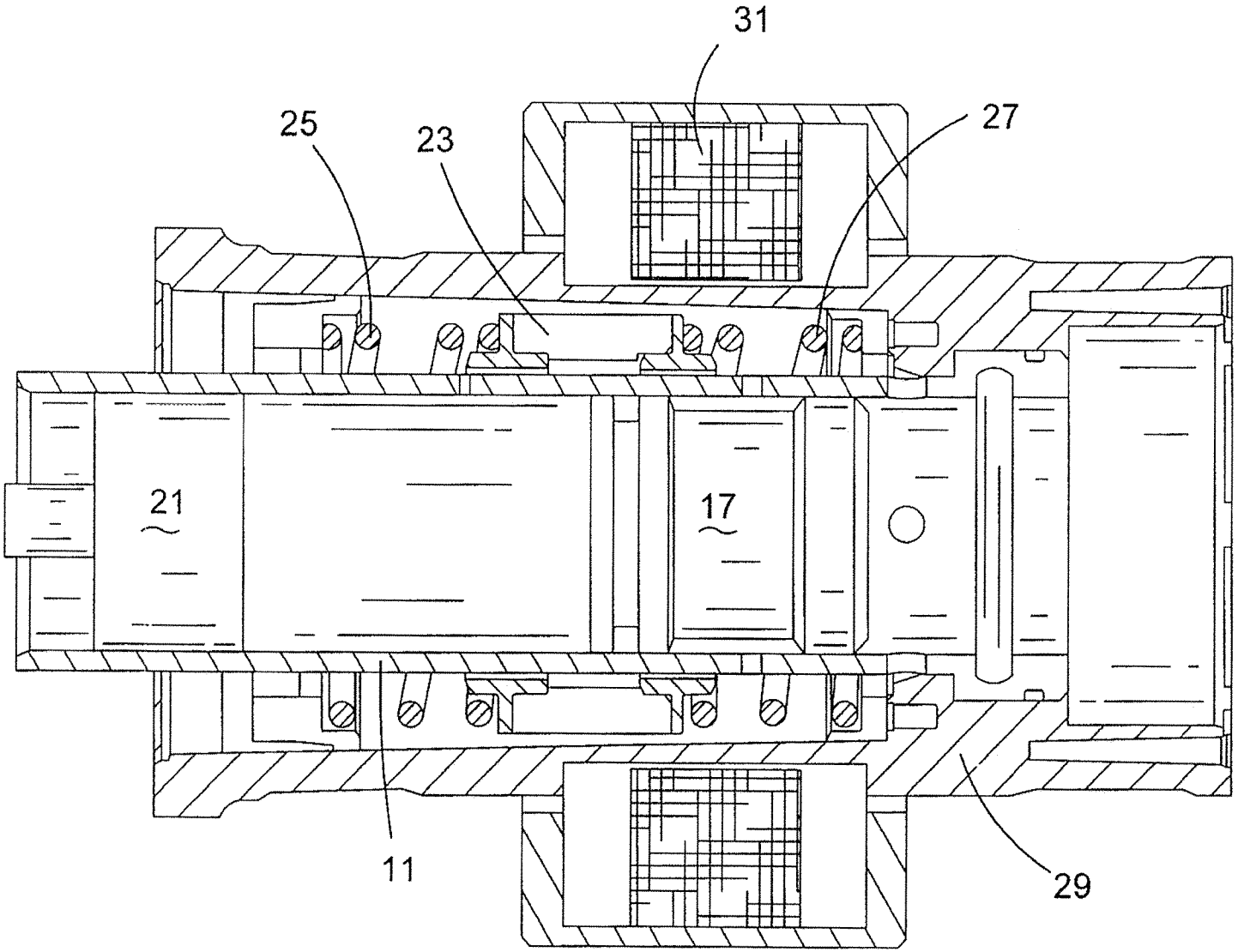
FIG. 4 shows an enlarged longitudinal cross-section of the percussion mechanism of a powered hammer according to a second embodiment.

FIG. 4 shows an alternative configuration of the solenoid 31 with respect to the percussion mechanism housing 29. Different to the embodiment shown in FIGS. 1 through 3, the solenoid 31 is located on the surface of the housing 29 facing away from the dampening mass.

Figure 5:
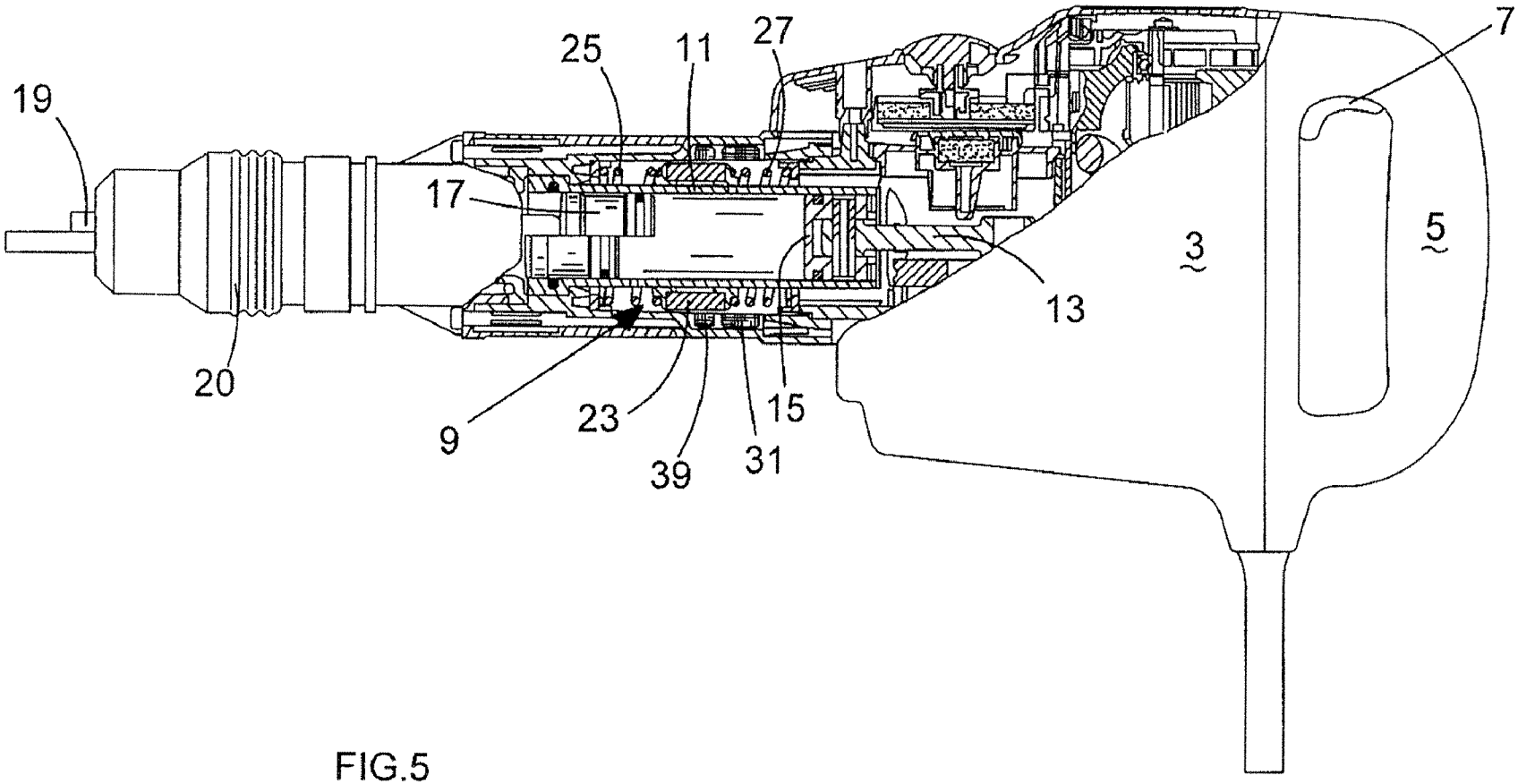
FIG. 5 shows a longitudinal cross section through a powered demolition hammer according to a third embodiment of the present invention.
Figure 6:
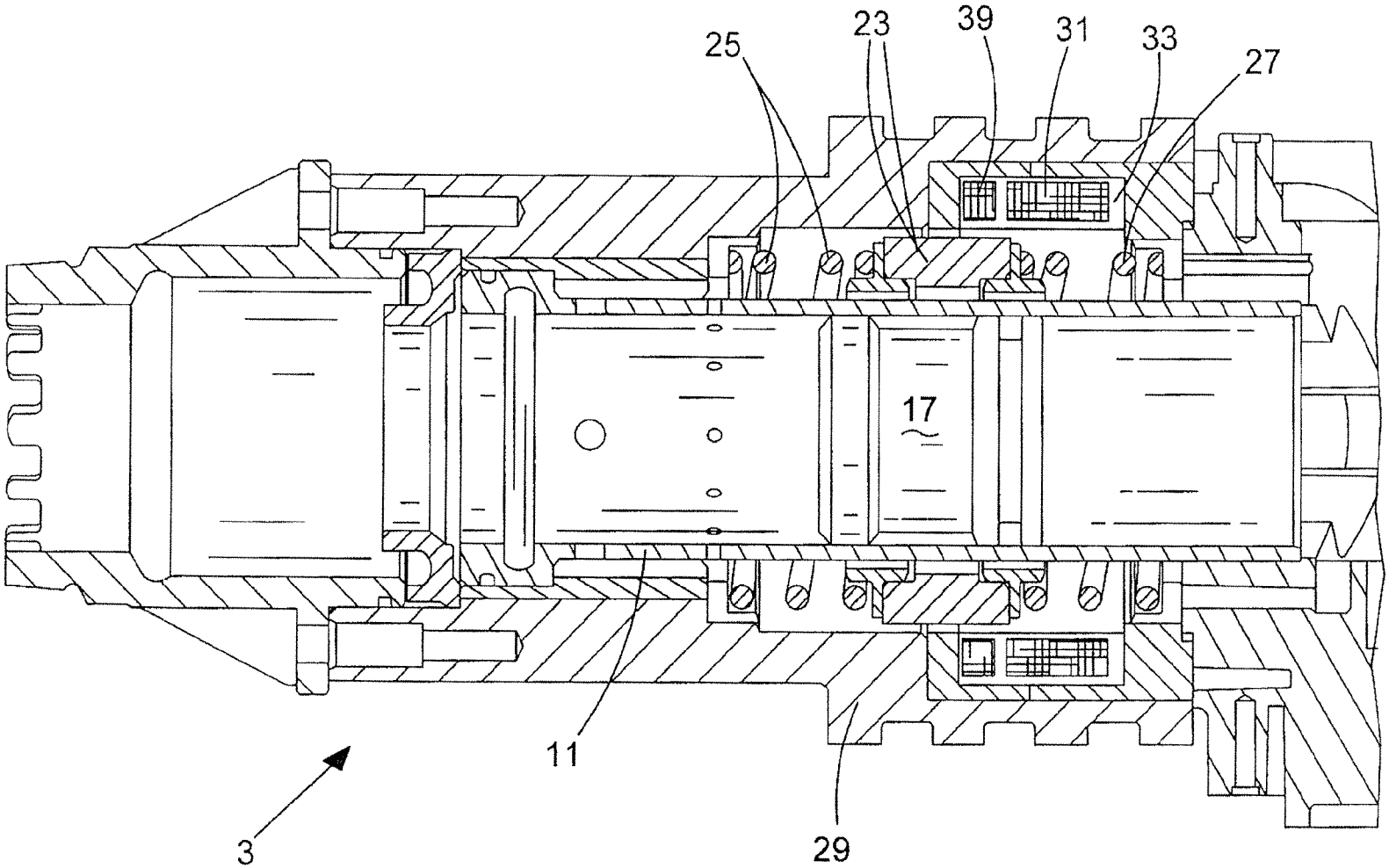
FIG. 6 shows an enlarged longitudinal cross-section of the percussion mechanism of the powered hammer shown in FIG. 5.

Finally, FIGS. 5 and 6 show an embodiment which employs a second solenoid 39 rather than an acceleration sensor. The second solenoid 39 is positioned adjacent to the first solenoid 31 within the ring-shaped recess 33 of the percussion mechanism housing.

Since the dampening mass 23 approaches or departs from the second solenoid 39 when moving in the longitudinal direction, the second solenoid 39 allows detecting the movement due to vibrations of the dampening mass 23 in the longitudinal direction as the resistance of the second solenoid 39 varies depending on the position of the dampening mass 23. In order to detect this, a small current will be supplied to the second solenoid 39 and its resistance will be determined. The resistance will be employed as the signal based on which the solenoid 31 is supplied with a current to deflect the dampening mass 23.

In conclusion, with the powered hammer according to the invention it is possible to reduce the vibrations generated by the percussion mechanism and transferred to a user wherein the dampening mass is accelerated by the solenoid 31.

The invention claimed is:

1. Powered hammer comprising: a housing, a tool holder mounted on the housing, a percussion mechanism arranged within the housing which mechanism includes a ram reciprocating in a longitudinal direction and being adapted to apply impacts on a tool bit supported in the tool holder, a dampening mass which is slidably mounted in the longitudinal direction within the housing, wherein the dampening mass is biased towards a neutral position by a biasing element and wherein the dampening mass may be deflected from the neutral position against the biasing force of the biasing element, wherein the dampening mass is formed of a ferromagnetic or paramagnetic material or comprises a permanent magnet, and wherein a solenoid is arranged within housing adjacent to the dampening mass such that the solenoid applies a force in the longitudinal direction on the dampening mass when being in the neutral position if a current is flowing through the solenoid, the powered hammer further comprising a control unit which applies a current to the solenoid depending on a signal which is a measure for the acceleration of the housing in the longitudinal direction.

2. Hammer according to claim 1, further comprising an acceleration sensor which is connected the control unit and which detects the acceleration of the housing in the longitudinal direction.

3. Hammer according to claim 1 , further comprising a second solenoid which is arranged such that the dampening mass when moving in the longitudinal direction approaches or departs from the second solenoid.

4. Hammer according to claim 3, wherein the percussion mechanism comprises a cylinder element in which the ram is movably located, wherein the dampening mass is of circular shape and wherein the dampening mass is supported by a spring.

5. Hammer according to claim 4, wherein the cylinder element and the dampening mass are surrounded by a percussion mechanism housing and wherein the solenoid is located along the circumference of the percussion mechanism housing spaced in the longitudinal direction from the neutral position of the dampening mass.

6. Hammer according to claim 5, wherein the percussion mechanism housing comprises a ring shaped recess which is located in the surface of the percussion mechanism housing facing the dampening mass.

7. Hammer according to claim 5, wherein the solenoid is located on the surface of the percussion mechanism housing facing away from the dampening mass.

8. Powered hammer comprising: a housing, a tool holder mounted on the housing, a percussion mechanism arranged within the housing which mechanism includes a ram reciprocating in a longitudinal direction and being adapted to apply impacts on a tool bit supported in the tool holder, a dampening mass which is slidable along a same longitudinal axis within the housing as the ram, wherein the dampening mass is biased towards a neutral position by a biasing element and wherein the dampening mass may be deflected from the neutral position against the biasing force of the biasing element, wherein the dampening mass is formed of a ferromagnetic or paramagnetic material or comprises a permanent magnet, and wherein a solenoid is arranged within housing adjacent to the dampening mass such that the solenoid applies a force in the longitudinal direction on the dampening mass when being in the neutral position if a current is flowing through the solenoid, wherein the solenoid is spaced in the longitudinal direction from the dampening mass when being in the neutral position.

9. Hammer according to claim 8, wherein the solenoid is spaced in the longitudinal direction from the dampening mass when being in the neutral position.

10. Hammer according to claim 8, further comprising a control unit which applies a current to the solenoid depending on a signal which is a measure for the acceleration of the housing in the longitudinal direction.

11. Hammer according to claim 10, further comprising an acceleration sensor which is connected the control unit and which detects the acceleration of the housing in the longitudinal direction.

12. Hammer according to claim 10, further comprising a second solenoid which is arranged such that the dampening mass when moving in the longitudinal direction approaches or departs from the second solenoid.

13. Hammer according to claim 12, wherein the percussion mechanism comprises a cylinder element in which the ram is movably located, wherein the dampening mass is of circular shape and wherein the dampening mass is supported by a spring.

14. Hammer according to claim 13, wherein the cylinder element and the dampening mass are surrounded by a percussion mechanism housing and wherein the solenoid is located along the circumference of the percussion mechanism housing spaced in the longitudinal direction from the neutral position of the dampening mass.

15. Hammer according to claim 14, wherein the percussion mechanism housing comprises a ring shaped recess which is located in the surface of the percussion mechanism housing facing the dampening mass.

16. Hammer according to claim 14, wherein the solenoid is located on the surface of the percussion mechanism housing facing away from the dampening mass.

* * * * *